United States Patent [19]

Hagemeister

[11] Patent Number: 4,577,684

[45] Date of Patent: Mar. 25, 1986

[54] PROFILED-TUBE HEAT EXCHANGER

[75] Inventor: Klaus Hagemeister, Munich, Fed. Rep. of Germany

[73] Assignee: MTU Motoren- und Turbinen-Union Munchen GmbH, Munich, Fed. Rep. of Germany

[21] Appl. No.: 640,396

[22] Filed: Aug. 13, 1984

[30] Foreign Application Priority Data

Aug. 12, 1983 [DE] Fed. Rep. of Germany ..... 3329202

[51] Int. Cl.[4] ..... F28F 9/00

[52] U.S. Cl. ..... 165/172; 165/162; 165/178

[58] Field of Search ..... 165/162, 172, 178, DIG. 13

[56] References Cited

U.S. PATENT DOCUMENTS

| | | | |
|---|---|---|---|
| 3,112,793 | 12/1963 | Sass | 165/172 X |
| 3,627,039 | 12/1971 | Tiefenbacher | 165/178 X |
| 3,885,936 | 5/1975 | Limebeer | 165/172 X |
| 4,040,476 | 8/1977 | Telle et al. | 165/178 X |
| 4,235,281 | 11/1980 | Fitch et al. | 165/118 X |
| 4,286,654 | 9/1981 | Ruhe et al. | 165/172 |
| 4,296,539 | 10/1981 | Asami | 165/115 X |
| 4,384,697 | 5/1983 | Ruhe | 165/162 X |
| 4,433,721 | 2/1984 | Biaggi | 165/162 |

FOREIGN PATENT DOCUMENTS

| | | | |
|---|---|---|---|
| 3329202 | 2/1985 | Fed. Rep. of Germany | 165/172 |
| 2289870 | 5/1976 | France | 165/DIG. 8 |
| 447239 | 3/1968 | Switzerland | 165/172 |

*Primary Examiner*—Sheldon J. Richter
*Assistant Examiner*—Randolph A. Smith
*Attorney, Agent, or Firm*—Roberts, Spiecens & Cohen

[57] ABSTRACT

A heat exchanger comprising a field of profiled tubes arranged in vertical columns and horizontal rows, each profiled tube being of oblong shape and, at least in part, surrounded by at least two supporting profile strips extending in the direction of fluid flow. The profiled strips of adjacent profiled tubes in a column are held at their ends in a well-defined position. Furthermore, the profile strips can rest directly or indirectly on other profile strips, adjacent thereto at the left or right, of adjacent profiled tubes. In this way, individual profiled tubes are longitudinally displaceable in an exact field arrangement and can compensate for changes in length.

17 Claims, 12 Drawing Figures

PROFILED-TUBE HEAT EXCHANGER

FIELD OF THE INVENTION

The invention relates to a heat exchanger having a plurality of tubes of oblong cross-section arranged in spaced relation in longitudinal columns and transverse rows to establish a matrix field in which a fluid flows around the tubes for heat exchange with fluid flowing in the tubes. The tubes in adjacent transverse rows are transversely offset from one another with the ends of the tubes on one row interposed between the ends of the tubes of adjacent rows thereby utilizing the widening spaces between the adjacent tubes of oblong sections.

PRIOR ART

A heat exchanger of this type is known from British Application No. 2,043,231 A. This Application, however, does not provide any teaching concerning the layer structure of the heat-exchanger matrix. Rather, pre-perforated metal plates are employed as spacers and these have disadvantages which are described hereafter.

In the case of a heat exchanger composed of profiled tubes which is exposed to high temperatures, each tube should be able to expand freely in the direction of its longitudinal axis in accordance with its individual thermal condition and independently of adjacent profiled tubes. Each tube, as part of an ordered matrix field, is assigned a given locus and given position, in the plane of the cross-section through the field, which it must maintain even under the action of thermal stresses. For this reason, some form of holders are necessary. It has been proposed to use correspondingly perforated sheet metal plates which, arranged at different heights, maintain the positions of the profiled tubes. The disadvantages of this construction are:

- -assembly is very inconvenient since each profiled tube must be pushed in the direction of its longitudinal axis and threaded through the different plates;
- -the array of holes in the metal plates is very difficult to produce;
- -the perforated plates are subject to thermal gradients in their plane which lead to stresses. Since the pattern of holes contains narrow bridges of material, stress concentrations occur at these points, with the danger of tearing, as a result of which the positioning and holding function is lost, at least locally.
- -the basic requirement of free longitudinal displaceability of each individual profiled tube results in rubbing movements between the surface of the tube and the side of the corresponding hole in the perforated plate which holds it laterally. Thus, there is a considerable danger that the tube will become excessively worn at this point.

SUMMARY OF THE INVENTION

An object of the present invention is to provide a heat exchanger having a matrix field of profiled tubes arranged in rows in which the above-mentioned disadvantages are overcome and, in particular, in which the profiled tubes are supported, locally in ordered fashion and substantially free of tension, by means of simple construction and simple assembly.

In order to achieve the above and further objects of the invention, it is contemplated to surround the profiled tubes at predetermined locations with profiled strips or sheet-metal bands which rest against both sides of the profiled tube and are so connected to each other or else to the profiled tube, or both, such that the profiled tube is partially surrounded in nondisplaceable fashion by the material of the strips or bands. The spacing by means of sheet-metal strips can be most simply effected by making the thickness of the metal strips which surround the profile equal to one-half the minimum spacing to be taken up between adjacent profiled tubes. The contacts between the strips are thus obtained, regardless of the shape of the profile, at locations between the end and the center of the profiled tube. In this respect the strips at the contacting locations have lines of contact which extend at an angle to the plane of the rows. Upon displacement of an individual profiled tube with respect to the rest of the field of tubes, parallel or perpendicular to the direction of the row, for instance due to thermal distortion, a wedge effect is produced. As a result of this wedge effect, a displacement force acting locally in the plane of the corresponding row produces large transverse reactions opposing the displacement, which is divided among the adjacent profiled tubes within the field. With this type of spacing, the regular arrangement of the profiled tubes, which for example are of oblong shape, provides for their densest packing. Any deviation of individual tubes or groups of tubes from their prescribed positions due, for example, to thermal distortions, results in an expansion of the field of tubes as a result of the aforementioned wedge effect and of elastic displacements.

This can be avoided by a further development of the invention in which the sheet-metal strips surrounding the tube extend, in the direction of external fluid flow around the profiled tube from the contact locations, further into the spaces between adjacent tubes. These ends of the strips serve as extensions which come together in the center of the spaces between the tubes. At the contact locations which are thus produced, the strips bear against each other in a manner such that the tubes which are arranged adjacent one another in the vertical columns are additionally prevented from moving out of their assigned positions in the field. Since there is merely contact but no connection at these locations, nothing prevents the individual longitudinal expansion of the profiled tubes or of the assembly of profiled tube and the strips except for friction at the points of contact resulting from the forces acting thereat. In order to improve the transmission of these holding forces, the points of contact can be obtained by contact elements or transfer members of a type described later. The contact elements can be connected to the ends or extensions of the sheet-metal strips either by surrounding the strips or being surrounded thereby.

The contact element can also connect the ends of the strips of adjacent tubes in a vertical column with the provision of an articulated connection point. The articulated connection point can be utilized for the assembly in which the contact element surrounds the strips or vice-versa.

In assemblies with articulated connection points, the individual expansion in length of a profiled tube, or of the assembly of profiled tubes with cover strips produces an angular displacement of the contact element with respect to the other profiled tubes connected to it. The articulated connection can include bushings and bolts made of wear-proof material. Side plates for chain-like connections can also be provided.

Another very advantageous effect of the contact elements is obtained if they are so dimensioned in their width that they fill the spaces between two adjacent profiled tubes in a transverse row. In this way, the contact elements also act as spacing elements in this direction and serve to maintain the arrangement of the profiled tubes within the field. The contact elements thus counteract any tendencies of the profiled tubes and strips from departing from their positions as a result of internal stresses, for example, due to temperature gradients. As a result of the prevention of expansion effected thereby, forces must be transmitted at the locations at which the spacing is maintained. Any differential expansions in vertical direction of the profiled tubes result in the production of frictional reactions at the spacing contact locations under the action of the holding forces. Superimposed on the relatively slow frictional movements are the movements from vibrations of the field of tubes.

In the sense of oscillation dynamics, the contact surfaces serve as an advantageous damping means. The surfaces in contact, however, are subject to frictional movements under these effects. In view of this, it is advantageous to provide additional members at the contact locations between the side walls of the sheet metal strips and the contact elements. On the one hand, the surfaces of the profiled tubes are thereby protected against wear by rubbing while, on the other hand, the places of contact can be made resistant to rubbing by the selection of a suitable material or the application of wear-resistant layers.

Of additional importance as a consequence of the construction of the invention, is the fact that torsional deformations of the profiled tubes are resisted over the greatest possible distance and therefore the forces resulting from the reaction moment at the contact locations is minimal.

It is furthermore advantageous if the holding forces are transmitted transversely to the direction of fluid flow in the region of transverse webs of the profiled tubes. In this way, forces which result from the support of the matrix of profiled tubes on adjoining structural components, for example, from mass actions by impacts and oscillations, are summated through the field of the profiled tubes and, propagated as compressive stresses at the rigid locations of the webs of the profiled tubes. This applies in similar manner to the transmission of forces in the direction of fluid flow, in connection with which the rigidity of the field results from the shape of the profiled tubes i.e. elongated in cross-section with a rounded oblong shape.

According to a further development of the invention, the spacing contact elements or force transfer bodies can be provided with fork-shaped extensions which are pushed from both ends over the profiled tube to surround the latter and be connected at abutment ends both with the profiled tube and with each other. The joint can alternatively be formed with an intermediate pressure piece which receives the lateral forces from the transfer members.

In a further development, the contact elements can also have ends which are in abutting engagement in form-locked manner, so that displacement of the profiled tubes in the vertical direction is possible.

DETAILED DESCRIPTION OF PREFERRED EMBODIMENTS OF THE INVENTION

Figure 1:
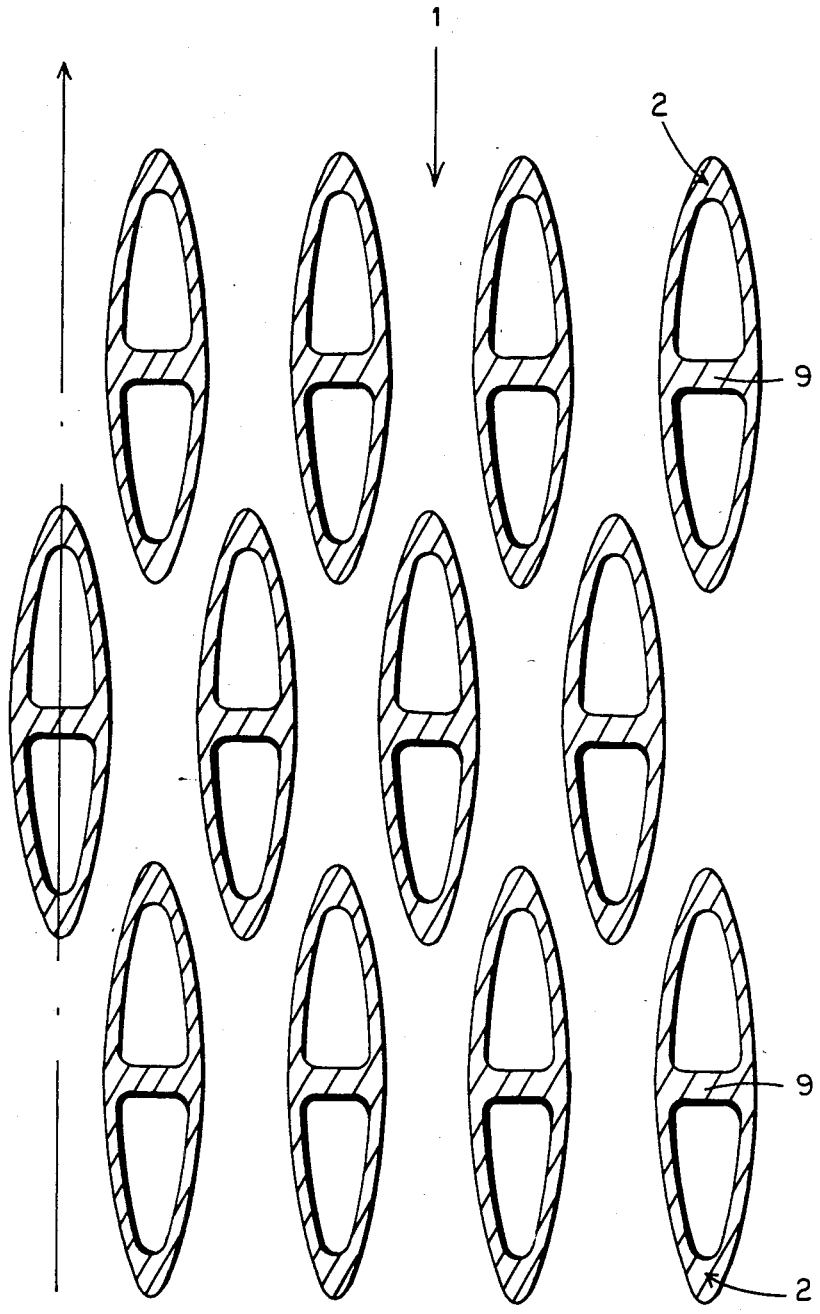
FIG. 1 is a diagrammatic cross-sectional view of a field of profiled tubes of a heat exchanger without any support means being shown.

FIG. 1 is a diagrammatic cross-sectional view of an arrangement 1 of profiled tubes 2 of a heat exchanger in which the support members for the tubes 2 have been omitted.

Each profiled tube 2 is a component of an orderly matrix field or array and has a given locus and a given position which is must maintain, in the plane of the cross-section through the field shown in FIG. 1, even under the action of thermal deformations. The tubes are of oblong cross-section and have central webs 9. The tubes are arranged in the matrix field in spaced relation in columns and rows and fluid flows in the direction of the arrow around the tubes to undergo heat exchange with fluid flowing in the tubes. Hereafter, the columns of tubes (which extend parallel to the fluid flow direction) will be referred to as longitudinal or vertical columns whereas the rows of tubes will be referred to as longitudinal or transverse rows. The matrix field illustrated is taken perpendicular to the length of the tubes.

The tubes in adjacent transverse rows are transversely offset from one another and the ends of the tubes of one row are interposed between the ends of the tubes of the adjacent rows to maximize the density of distribution of the tubes in the matrix field.

Figure 2:
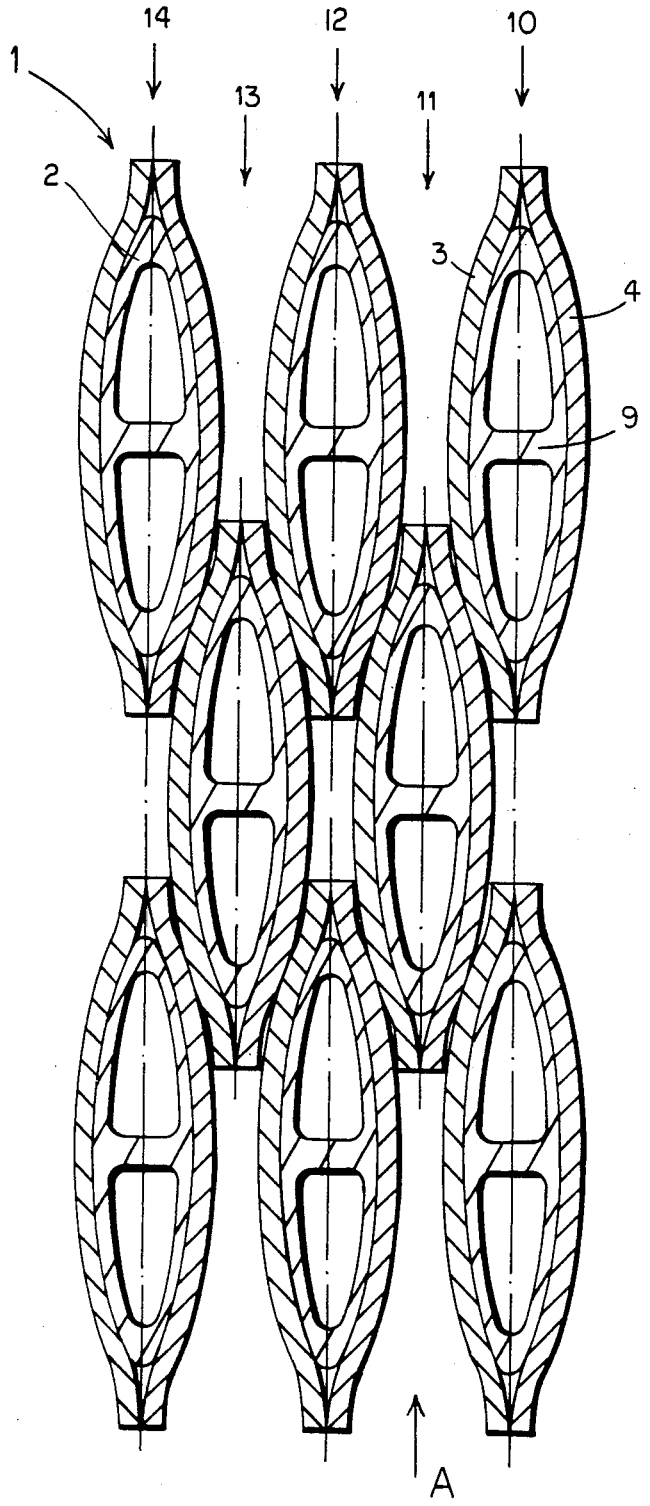
FIG. 2 shows a portion of the profiled tubes of FIG. 1 with associated support or mounting means.

FIG. 2 shows a first embodiment of a spacer means for maintaining the position of the tubes 2 in the matrix field comprising profiled strips 3,4 in the form of sheet metal strips or bands at predetermined places serving as spacers for establishing and maintaining the position of the profiled tubes 2 in the matrix field.

As seen in FIG. 2, each profiled tube 2 has an associated left-hand profiled strip 3 as well as a right-hand profiled strip 4 which strips are of substantially identical mirror-image construction. The two strips 3,4 extend substantially in the direction of flow A of hot gases in the matrix field of the profiled tubes and the strips 3,4 are of the same length, which is longer than the length of the associated profiled tube 2.

The profile strips 3,4 in FIG. 2 have a thickness to fill the spaces present between the ends of two adjacent profiled tubes 2 such that space-maintaining contacts are produced at these locations. Such a configuration is of simple construction and is easy and economical to manufacture. A transmission of forces takes place between adjoining strips at the aforesaid ends in the form of an oblique contact between the corresponding strips to provide wedge-shaped support contact for the tubes 2. All profiled tubes 2 are thus surrounded at their surfaces and extend in columns and rows alongside one another as shown in FIG. 2 within the entire field of the profiled tubes. The profiled tubes 2 or the assemblies thus formed of the profiled tubes 2, are arranged in vertical columns 10, 11, 12, 13 and 14 and the tubes in each column are vertically spaced apart and in oblique contact with the strips of the tubes in adjacent left and right columns. The tubes in each column are displaceable relative to each other in the length direction. The profiled strips 3,4 of each profiled tube 2 are, in the embodiment of FIG. 2, securely attached to each other so that the enclosed profiled tube 2 is surrounded in non-displaceable manner by the strips.

The strips 3,4 are arranged in one or more common planes along the length of the tubes and occupy a relatively small portion of the length of the tubes to have minimal interference with the fluid flow around the tubes and the heat exchange therewith.

Figure 3:
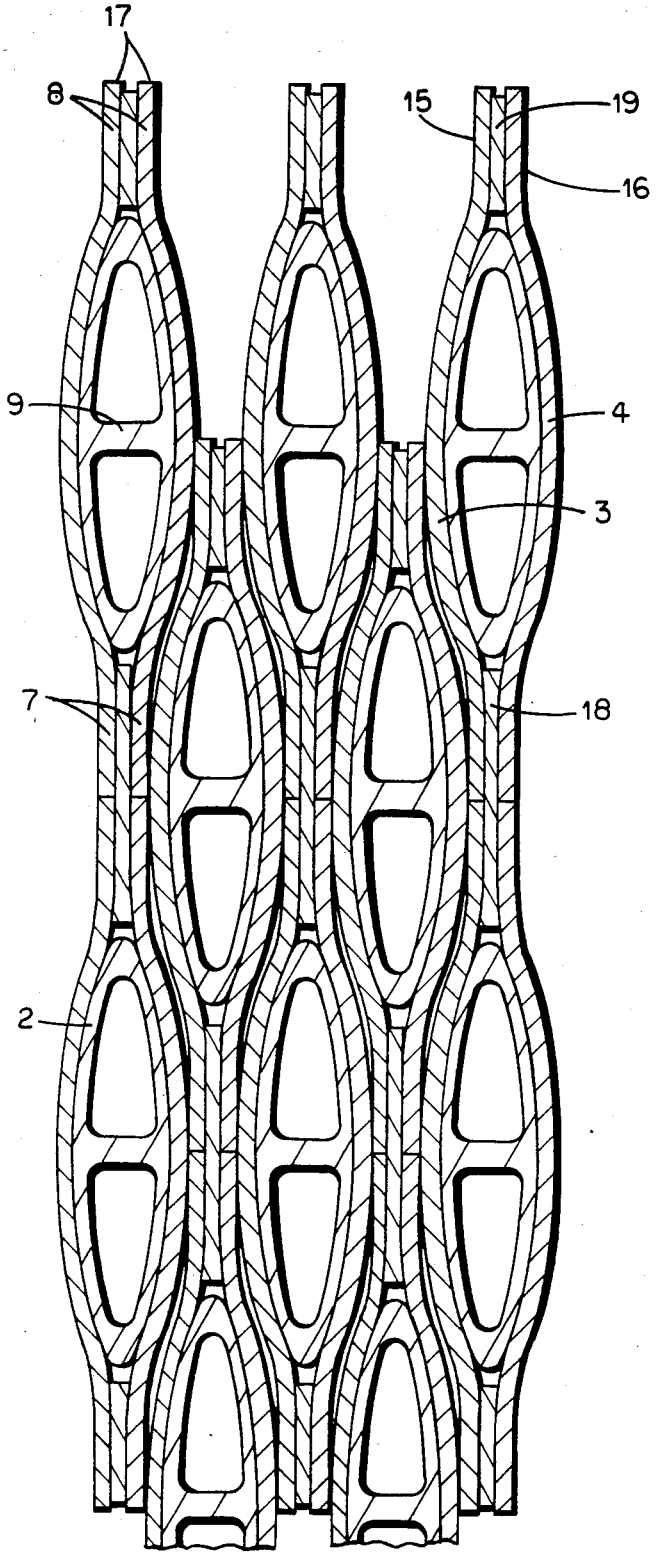
FIG. 3 shows a different embodiment of support means for the profiled tubes.

The spacing achieved by the profiled strips in the form of sheet metal bands which locally surround the profiled tube can be effected in the manner shown in FIGS. 3 et seq. if there are higher demands in the precision of the positioning and particularly when higher temperature gradients are present. In FIG. 3, the profiled tubes are surrounded on their outer surfacesby profiled strips as before and they are arranged in rows and columns in the total field. Adjacent profiled tubes 2 in adjacent rows are staggered with respect to each other as seen in cross-section and the tubes have the same overall lengthwise orientation. The mutual support in the transverse direction i.e. horizontally is effected by side surfaces 15,16 of the ends 7,8 of the profiled strips, in each case, centrally against the outer surfaces of the profiled strips 3,4 adjoining on the left and right sides, of the profiled tubes of the adjacent rows. In the longitudinal direction, the mutual support takes place edgewise on the end surfaces 17 of the ends 7,8 of the profiled strips. The widthwise spacing of the outer surfaces 15,16 of the profiled strips 3,4 is so dimensioned, according to FIG. 3, that it fills the space between the profile strips 3,4 of two profiled tubes which are adjacent to each other transverse to the direction of flow i.e. in transverse rows and which belong to the two adjacent columns at the left and right. The distance required for this between the ends 7,8 of the profiled strips can be provided by embossed projections on the strips, or as shown in FIG. 3, by interposed connecting bodies 18,19.

Figure 4:
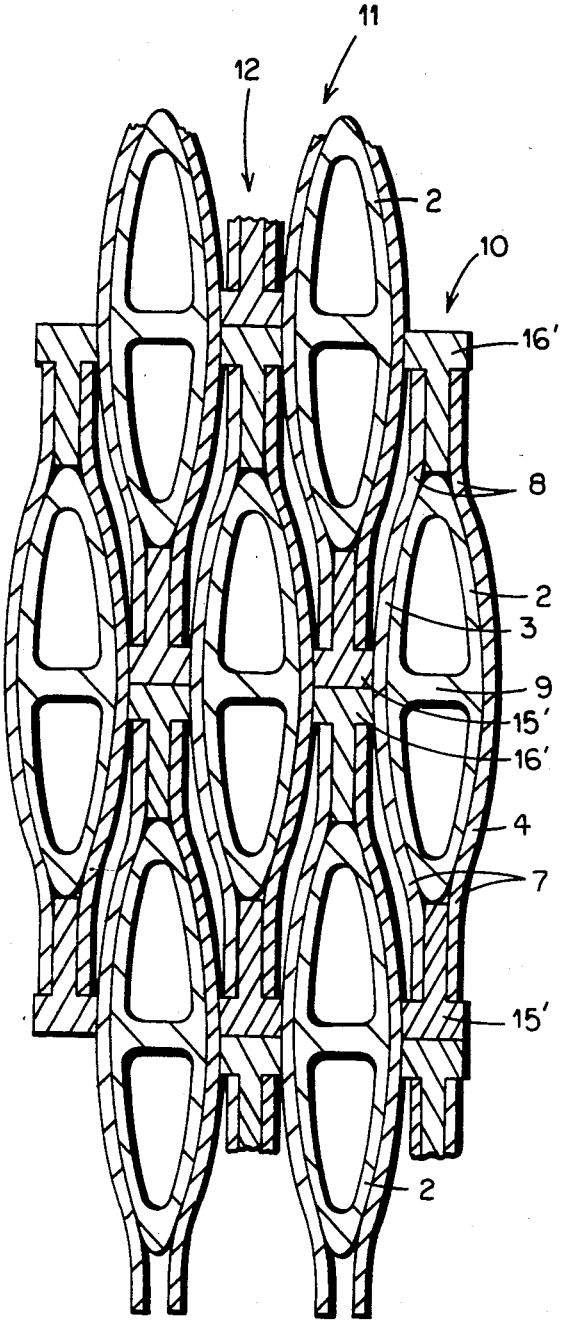
FIG. 4 shows modification of contact elements of the support means of the profiled tubes according to FIG. 3.
Figure 5:
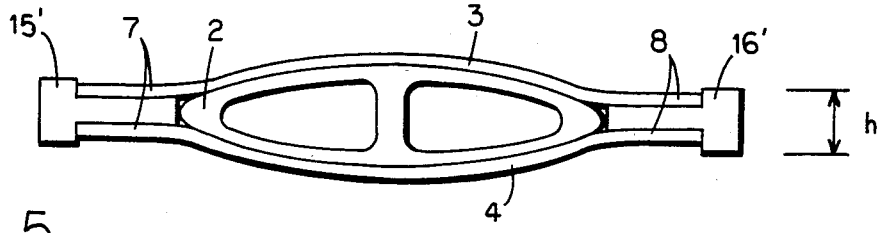
FIG. 5 shows an individual profiled tube of FIG. 4 with a surrounding contact element.

The connecting bodies can also be formed as contact elements 15',16', as shown in FIGS. 4 and 5. Two profile strips 3,4 of each profiled tube 2 have ends which extend parallel to each other and are aligned with and spaced from each other, the first profiled strip ends 7 (the lower end in FIG. 4) receiving a first contact element 15' and the corresponding second profiled strip ends 8 at the upper end of the same profiled tube 2 receiving a corresponding second contact element 16'.

The height and width of the contact elements 15',16', serving as connecting bodies, are so dimensioned that they fill the space between two profiled tubes 2 which are adjacent one another in transverse rows. In this regard, as seen in FIG. 4, the corresponding side surfaces of the contact pieces 15', 16' are curved in correspondence with the adjoining mating surfaces of the profiled strips 3,4.

The contact elements 15',16' thus act as spacing elements not only in the direction of flow but also in the transverse direction and have the function of maintaining the position of the profiled tubes in the entire field.

The contact elements 15',16' abut against each other in the region where the adjacent profiled tubes 2 have the inner central transverse web 9. In this way, good conditions for effective transfer of forces are obtained. The arrangement is such that individual profiled tubes are longitudinally displaceable with respect to each other i.e. along their lengths as a result of thermal influences without changing their positional arrangement in the plane of the cross-section through the field. Adjacent contact elements 15',16' carry out relative movement with respect to each other and with respect to adjacent profile strips 3,4. In order to minimize frictional wear, at least the outer surfaces of the profile strips 3,4 are hardened on their surface or provided with wear-resistant coating.

Figure 6:
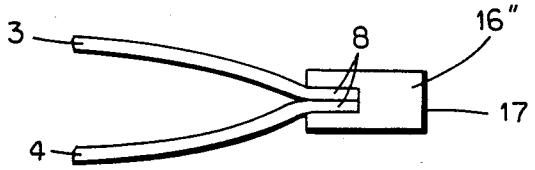
FIG. 6 shows a portion of the individual profiled tube of FIG. 4 with a modified contact element.

An embodiment of a mounting for profiled tubes 2 is shown in FIG. 6 and comprises connecting member 16'' which engages in tong-like manner around the corresponding profile strip ends 8 in contradistinction to the embodiment shown in FIG. 5.

Figure 7:
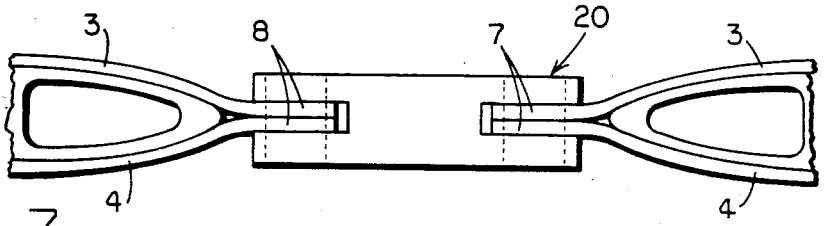
FIG. 7 shows another embodiment of a contact element connecting two profiled tubes in chain-like manner.
Figure 8:
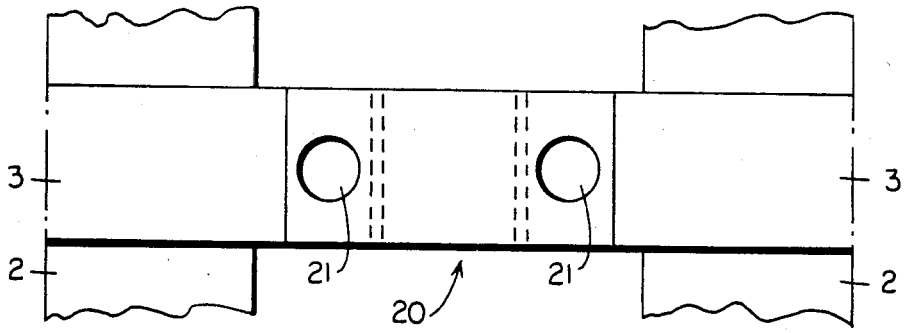
FIG. 8 is a top view of the construction in FIG. 7.

FIGS. 7 and 8 show a contact member 20 used as a connecting member between adjacent profiled tubes 2 in a column. The contact member 20 connects the extensions or ends 7,8 of the profiled strips 3,4 pivotally to each other in the manner of chain links, as shown in FIGS. 7 and 8. The contact member 20 has an articulated pin connection 21 for each pair of strips. In the connection in FIGS. 7 and 8, an individual longitudinal expansion of a profiled tube with respect to the tubes connected thereto will produce an angular displacement of the contact element 20.

Figure 9:
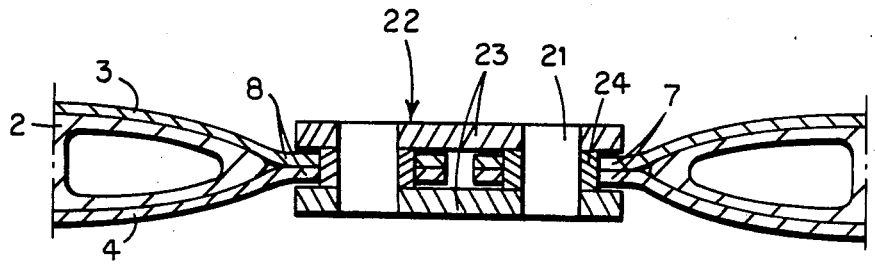
FIG. 9 is a diagrammatic cross-sectional view of another bodiment of a contact element connecting two adjacent profiled tubes.

The connection can also be made in the manner shown in FIG. 9 in which bushings 24 surround pins 21 and articulated movement takes place between the bushings 24 and the pins 21. The bushings are made of wear-resistant material. In this construction, the contact element 22 is composed of two outer guide plates 23.

Figure 10:
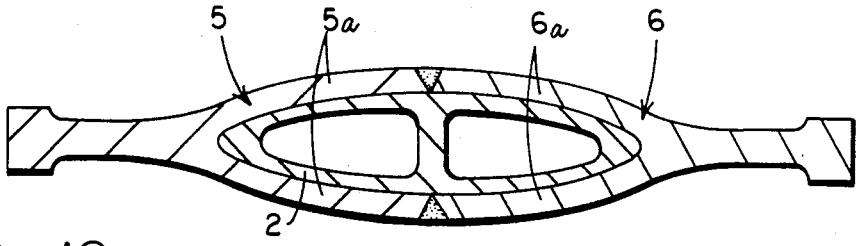
FIG. 10 shows an individual profiled tube with fork-shaped transfer members.

In a further embodiment of the invention, the spacer elements are formed as transfer members or profile strips 5 and 6 which have fork-shaped extensions **5*a*, 6*a* which can be pushed from both ends over a profiled tube 2 to surround the tube. The extensions 5*a*, 6*a* are connected to each other by welding at their abutting ends as shown in FIG. 10**.

Figure 11:
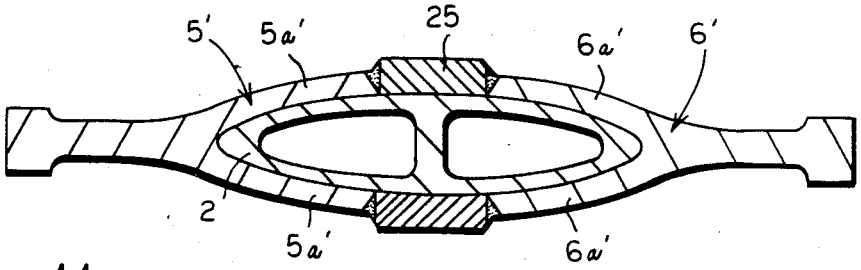
FIG. 11 shows a modification of the embodiment of FIG. 10 utilizing interposed pressure pieces.

In a modification as shown in FIG. 11 a pressure piece 25 is interposed between the corresponding fork-shaped extensions **5*a*',6*a*' of the profile strips 5',6'** to resist lateral forces from the profile strips.

Figure 12:
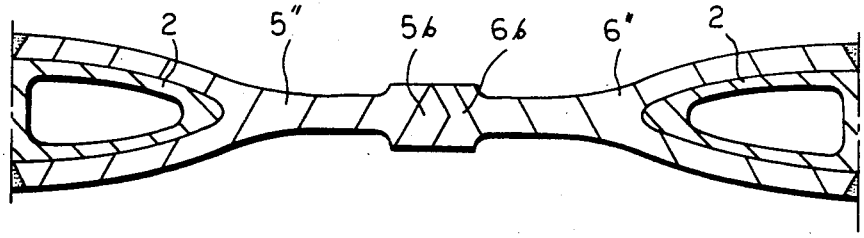
FIG. 12 shows adjacent profiled tubes with another embodiment of fork-shaped transfer members.

In a further modification as shown in FIG. 12 adjoining fork-shaped profile strips 5'',6'' of adjacent profiled tubes 2 in a column are centered and engaged in form-locked manner as shown by interengaged ends **5*b*, 6*b***. The engagement permits displaceability in the longitudinal direction of the tubes.

The profile strips can be surface hardened or at least provided, in part, with a coating which is resistant to frictional wear.

With reference again to FIGS. 4 and 5, it is seen therefrom that the width h of the contact elements 15',16' of two profiled tubes 2 in column 11 is equal to the distance between the left-hand profile strip 3 of the profiled tube 2 in column 10 and the right-hand profile strip 4 of the corresponding profiled tube 2 of column 12. In this way, the contact elements adjoin the strips of adjacent tubes in the transverse direction of the matrix. Basically, each contact element 15',16' includes a stem interposed between the ends of adjacent strips and an enlarged head of width h.

Furthermore, as already indicated, each profiled tube 2 can be surrounded in non-displaceable manner, for example, by the profile strips, 3,4 in FIG. 4 so that the profile strips 3, 4 are displaceable together with the corresponding profiled tube 2 lengthwise of the tube.

Although the invention has been described in relation to a number of embodiments thereof, it will become apparent to those skilled in the art that numerous modifications and variations can be made without departing from the spirit and scope of the invention as defined in the attached claims.

What is claimed is:

1. In a heat exchanger having a plurality of tubes of oblong cross-section arranged in spaced relation to longitudinal columns and transverse rows to establish a matrix field in which a fluid flows in a longitudinal direction around the tubes for heat exchange with fluid flowing in the tubes, the tubes in adjacent transverse rows being transversely offset from one another with the ends of the tubes in one row interposed between the ends of the tubes of adjacent rows, the improvement comprising:

means interposed between adjacent tubes in adjacent rows and columns for maintaining the position of the tubes in the matrix field, said means comprising a pair of profiled strips for each tube, said strips being disposed in said matrix field in a common plane extending perpendicular to said tubes, each profiled strip including a portion curved in shape in conformance with said tube, said curved portions of said strips being secured to respective opposite sides of said tube to substantially surround said tube, each tube and the pair of profiled strips secured therewith being freely expandible lengthwise of the tubes independently of the adjacent tubes and strips, said strips further including ends extending longitudinally beyond the ends of the associated tube to be interposed between strips of adjacent tubes at the center of the curved portions of said adjacent tubes, and connecting members inserted between said ends of the strips of each tube to form with said ends, spacers for said tubes and contact locations of said strips and said tubes to resist torsional deformation of the matrix field, said tubes each including a central transverse web at the center of said curved portions.

2. The improvement as claimed in claim 1 wherein said ends of said strips have edges which abut one another for adjacent tubes in the longitudinal columns.

3. The improvement as claimed in claim 1, said connecting members each comprising a contact element connected to the ends of the strips.

4. The improvement as claimed in claim 3 wherein the contact elements of adjacent tubes in each column are in abutment with one another.

5. The improvement as claimed in claim 4 wherein said contact elements are separable from one another at the abutment surfaces in the longitudinal direction.

6. The improvement as claimed in claim 4 wherein said contact elements include stems engaged between the ends of adjacent strips and enlarged heads on said stems projecting from said strips.

7. The improvement as claimed in claim 6 wherein said heads have curved side surfaces in contact with strips of adjacent tubes in each row.

8. The improvement as claimed in claim 5 wherein each said contact element includes a grip portion which grips the ends of the associated strips in tong-like manner and an opposite end portion which abuts the end portion of the contact element of the adjacent tube in the longitudinal column.

9. The improvement as claimed in claim 3 comprising means pivotably connecting said contact elements and the ends of the strips in chain-like manner.

10. The improvement as claimed in claim 1 wherein said ends of said strips are integrally connected to form a fork-shaped element whose curved portions extend from the integrally connected ends to contact the sides of the associated tube.

11. The improvement as claimed in claim 10 wherein two fork-shaped elements have their curved portions in endwise abutting, secured relation to form the strips of each tube.

12. The improvement as claimed in claim 10 wherein two fork-shaped elements have the ends of the curved portions in spaced relation, and pressure elements are interposed and secured to said fork-shaped ends to form the strips of each tube.

13. The improvement as claimed in claim 10 wherein the facing ends of fork-shaped elements of adjacent tubes in longitudinal columns respectively include means for engaging said ends in centered form-locked manner while providing relative displacement lengthwise of said tubes.

14. The improvement as claimed in claim 1 wherein said profiled strips have outer surfaces which are hardened.

15. The improvement as claimed in claim 1 wherein said profiled strips have a coating at least on a part of their surfaces for reducing frictional wear.

16. The improvement as claimed in claim 1 wherein said profile strips are sheet metal bands.

17. The improvement as claimed in claim 3 wherein said contact element has a width which is substantially equal to the spacing between the opposed strips of adjacent tubes in each transverse row.

* * * * *